US005722921A

United States Patent [19]

Simonson

[11] Patent Number: 5,722,921

[45] Date of Patent: Mar. 3, 1998

[54] RANGE LIMITING DEVICE FOR EXERCISE EQUIPMENT

[75] Inventor: Roy Simonson, Colorado Springs, Colo.

[73] Assignee: Cybex International, Inc.

[21] Appl. No.: 796,799

[22] Filed: Feb. 6, 1997

[51] Int. Cl.[6] ..... A63B 21/00

[52] U.S. Cl. ..... 482/100; 482/137; 482/908

[58] Field of Search ..... 482/94–100, 136–138, 482/908

[56] References Cited

U.S. PATENT DOCUMENTS

| | | | |
|---|---|---|---|
| 3,856,297 | 12/1974 | Schnell . | |
| 4,199,139 | 4/1980 | Mahnke et al. . | |
| 4,200,279 | 4/1980 | Lambert, Jr. . | |
| 4,311,305 | 1/1982 | Lambert, Jr. et al. . | |
| 4,411,424 | 10/1983 | Barnett . | |
| 4,422,636 | 12/1983 | DeAngeli . | |
| 4,515,363 | 5/1985 | Schleffendorf . | |
| 4,621,807 | 11/1986 | Stramer . | |
| 4,709,920 | 12/1987 | Schnell . | |
| 4,709,922 | 12/1987 | Slade, Jr. et al. . | |
| 4,763,897 | 8/1988 | Yakata . | |
| 4,793,608 | 12/1988 | Mahnke et al. . | |
| 4,836,536 | 6/1989 | Jones . | |
| 4,842,271 | 6/1989 | Vinciguerra . | |
| 5,102,121 | 4/1992 | Solow et al. . | |
| 5,356,360 | 10/1994 | Johns | 482/99 |

*Primary Examiner*—Richard J. Apley
*Assistant Examiner*—John Mulcany

[57] ABSTRACT

A range limiting device for use in an exercise machine having a cam and an input arm fixed to a shaft, wherein the shaft is pivotally mounted to a frame. The range limiting device includes a cam arm pivotally mounted to the cam arm so as to maintain a tether substantially tangential to the outer perimeter of the cam. A detent pin mounted to the cam arm selectively locks the orientation of the cam arm with respect to the cam. A stop cam is pivotally mounted to the frame coaxial with the shaft and includes a stop member positioned to interfere with the rotation of the input arm. The orientation of the stop cam is locked by a detent pin mounted to the frame.

11 Claims, 13 Drawing Sheets

TO FIG. 7A

RANGE LIMITING DEVICE FOR EXERCISE EQUIPMENT

BACKGROUND OF THE INVENTION

This invention relates to a device for limiting the range of motion on exercise machines, particularly on weight-lifting machines using selectorized variable-resistance.

Selectorized weight machines have been used in fitness clubs and athletic facilities for many years. These machines allow the user to select the weight to be lifted during a certain exercise or training protocol.

One type of a selectorized weight machine is one which allows for variable-resistance along the range of motion of the exercise being performed. These selectorized variable-resistance machines use a cam having a variable radius or cam profile. A tether such as a wire cable, a chain, a belt, or the like is attached at one end to a weight stack and is attached at the other end to the cam. The changing cam profile varies the mechanical advantage of the weights for the user. The cam profile is designed to approximate the change in anatomical mechanical advantage for the user at different points of the range of motion.

When the user is at a "weak" point where the user is unable to lift much weight, the cam profile will minimize the mechanical advantage that the weight stack has on the user. Similarly, at a user's "strong point", the cam profile is designed to maximize the mechanical advantage that the weight stack has on the user. This process is accomplished by varying the radius of the cam profile such that in the ideal situation, the user is lifting as much weight he or she can at each point in the user's range of motion.

The "selectorized" aspect of selectorized variable-resistance exercise machines allows the user to select how many weight plates from a weight stack the user wishes to lift for a particular exercise. The desired number of plates is typically chosen by the user by inserting a pin into a hole in one of the plates. Selectorized variable-resistance weight machines are well known in the commercial industry, for example, those prior models made by CYBEX International, Inc. (the assignee of the present application) and Nautilus Sports Medical Co.

Selectorized variable-resistance weight machines are used in the rehabilitation field, as well as for exercise and training. For rehabilitation purposes, it is often important to limit the range of motion for the patient. For example, after certain knee injuries, it is important that the patient avoid loading muscles with weights at certain points in the range of motion. However, for other points in the range of motion use of a weight machine may play an important part in the rehabilitation routine. Thus, selection of the correct start and stop point in the range of motion is critical to prevent injury. Sports medicine and rehabilitation physicians and physical therapists have long recognized that there are certain safe ranges of motion for rehabilitation for certain injuries, and that the use of selectorized variable-resistance exercise machines can aid in rehabilitation within the critical range limits.

In exercise and training fields, there also exists many advantages in limiting the range of motion. For example, athletes sometimes concentrate on developing muscle strength in a particular part of the body for bulk over a limited, specified range of motion.

Prior art machines for limiting the range of motion in exercise machines have typically fallen into two categories. In both categories, the stop or end position for the range of motion is accomplished by adjusting the location of a stop pin or a block such that the input assembly or rotating member of the machine hits the pin or block at a desired stop point in the range of motion.

The difference between the two categories of prior art machines relates to the manner in which the start position for the desired range of motion is accomplished.

In the first category, the user or therapist rotates the input assembly to a desired starting point, thereby also lifting the weights. A mechanical stop is then inserted against which the input assembly or rotating member rests.

The first category of machines suffers from the disadvantage that the weight stack must be lifted and a mechanical stop must be inserted for each adjustment to be complete.

The second category of machines disconnects the input assembly or rotating member from the weight stack and cam before the adjustment of the start position can be made. This can be done, for example, by use of a clutch or pull pin. This has disadvantages for variable-resistance machines. Once the input assembly or rotating member is reoriented with respect to the cam on a variable-resistance machine, the variable anatomical mechanical advantage of the user and the variable mechanical advantage of the cam are no longer synchronized. Depending on the particular exercise, training or rehabilitation protocol, the maximum cam effect could occur at the user's weakest point of anatomical advantage, resulting in a risk of injury to the user.

One device which has attempted to overcome the above disadvantages is disclosed in U.S. Pat. No. 5,102,121. This range limiting device utilizes a pair of parallel arms mounted on either side of a variable radius cam so as to pivot about a common axis as the cam. A weight cable is wrapped around the cam and connected to a cam follower which is supported between the two parallel arms in a manner to track the perimeter of the cam profile. A detent pin mounted to one of the parallel arms selectively engages one of a plurality of holes in the cam to selectively lock the orientation of the parallel arms with respect to the cam. While this system provides for start position adjustment without displacing the weights, it requires the cam follower to track the cam profile without interference in order to maintain the cable tangential to the cam along the cam profile.

Thus, there remains a need for a simple range-limiter device for exercise machines that does not require the weight stack to be lifted to make start position adjustments nor require reconfiguring the relationship between the anatomical mechanical advantage of the user and the cam profile to make such an adjustment.

SUMMARY OF THE INVENTION

Accordingly, it is an object of the present invention to provide a range-limiter for an exercise machine, particularly a weight machine employing selectorized variable-resistance, which is simpler, more versatile, and easier to operate than prior art devices.

It is another object of the invention to provide a range limiter than can be used to assist patients in rehabilitation, as well as athletes in training, by maximizing the mechanical advantage of the weight stack on the user when the user is at a "strong" point and minimize the mechanical advantage of the weight stack on the user when the user is at a "weak" point.

A further object of the invention is to provide a range limiter that provides an easy method for adjusting the start and stop point for a rehabilitation protocol or training exercise that does not require the weight stack to be lifted or the input assembly to be re-oriented so that the anatomical mechanical advantage of the user and the mechanical advantage of the cam remain synchronized.

These and other objects of the present invention are met by a range limiter for adjusting the range of motion on an exercise machine, particularly a weight machine with a selectorized variable-resistance. The machine has a frame, a shaft rotatably mounted to the frame, a cam fixed to the shaft, an input assembly fixed to the shaft, a resistance means and a tether assembly operably connected to the resistance means. The range-limiter of the present invention includes a cam arm pivotally mounted to the cam and operably connected to the tether assembly so as to maintain the tether substantially tangential to the cam profile. Connecting means are provided to selectively lock the orientation of the cam arm with respect to the cam.

The steps of the method include disengaging the first mechanical pin means, rotating the input assembly and cam means to a desired location, and re-engaging the first mechanical pin.

BRIEF DESCRIPTION OF THE DRAWINGS

The present invention can be better understood when considered with the following drawings wherein.

DETAILED DESCRIPTION OF PREFERRED EMBODIMENT

Figure 1A:
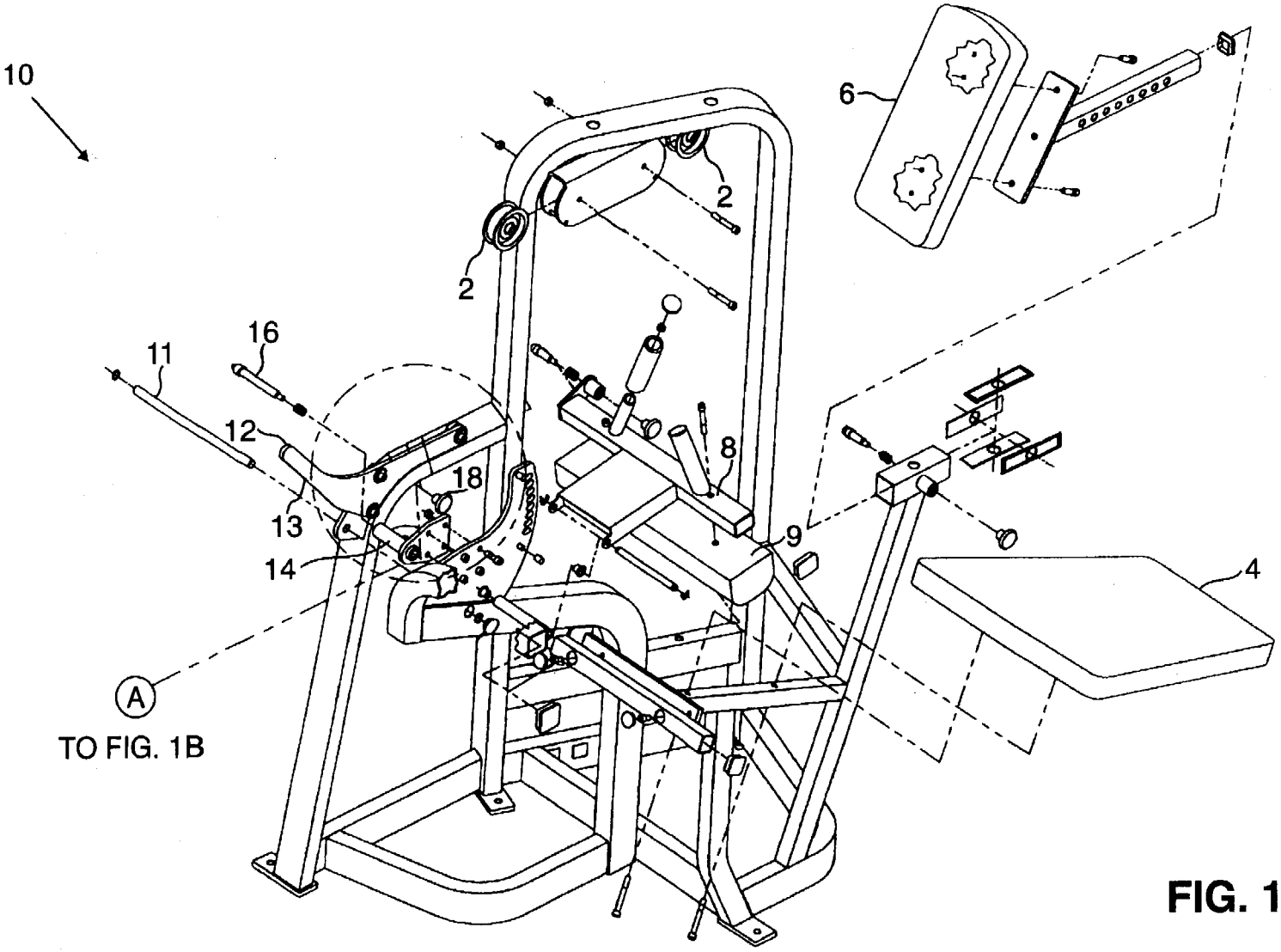
FIGS. 1A and 1B are an exploded view of a leg curl exercise machine having a range limiting device of the present invention.
Figure 1B:
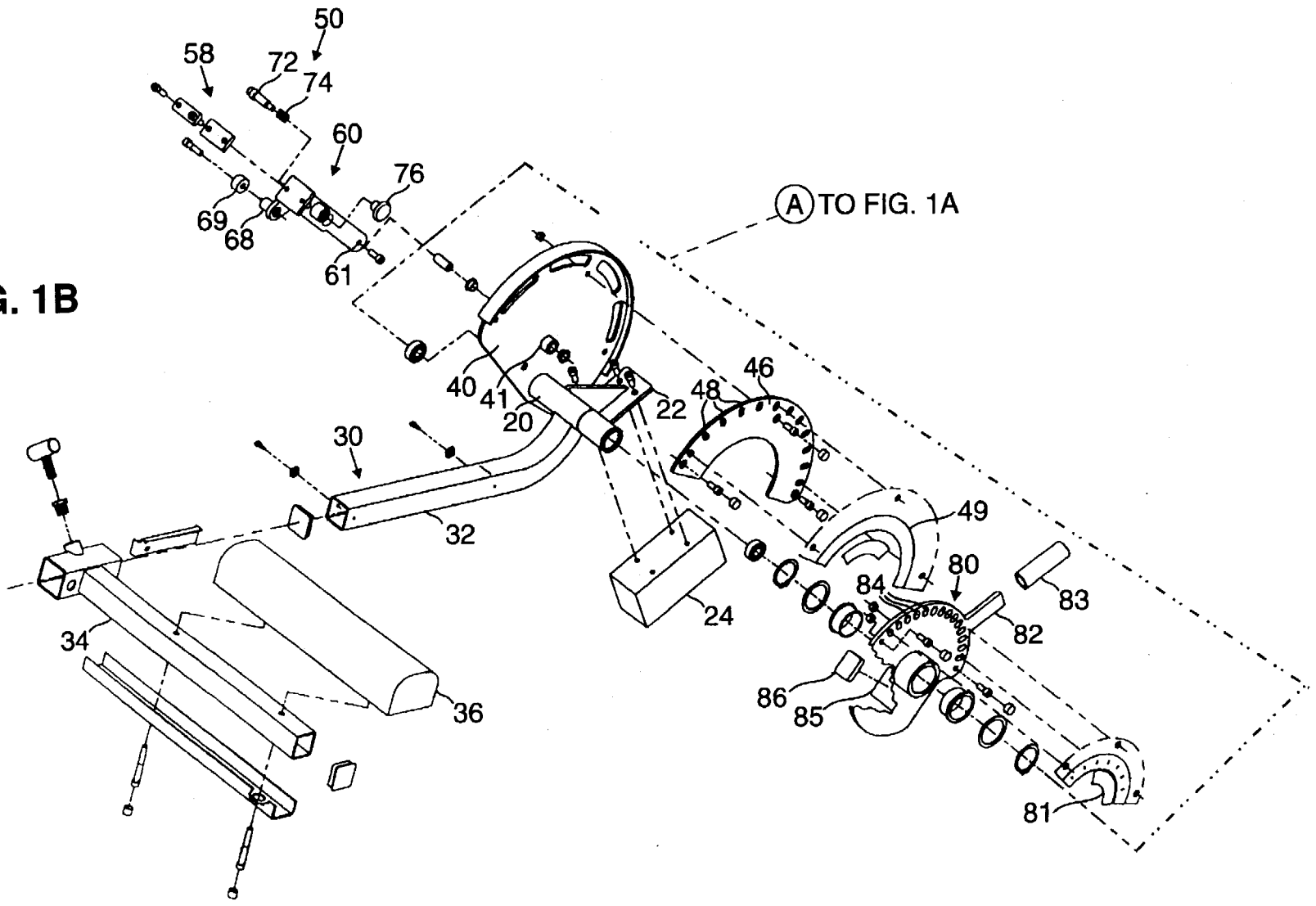

Referring to FIGS. 1A and 1B, the range limiter of the present invention is shown in an exploded view as part of a leg curl exercise machine. The left hand side of FIG. 1A is a continuation of the right hand side of FIG. 1B.

The exercise machine includes a shaft 20 pivotally mounted to the front of a frame 10 of the exercise machine. In the preferred embodiment, the shaft 20 is mounted about rod 11 by bearings, as is conventional in the art. An input assembly 30, for engaging the limbs of a user during a training exercise or rehabilitation protocol, is fixed at one end to the shaft 20.

In the embodiment of FIGS. 1A and 1B, the input assembly 30 includes an input arm 32 mounted to the shaft 20 and a leg bar 34 mounted to the input arm 32 in a perpendicular orientation to engage the rear of a user's lower leg. The leg bar 34 may be slid along the input arm 32 to allow adjustment for different users and may also include a pad 36 to cushion the contact point between the leg bar 34 and the user's legs.

A user support is mounted to the rear of the frame 10 and includes a seat 4 and an adjustable backrest 6, both of which are conventional in the art. Likewise, an adjustable leg support 8 is mounted to the frame in front of and above the seat 4 in a position to engage the top of a users leg, just above the knee, when the user is seated on the seat 4. A pad 9, similar to pad 36, is mounted to the leg support to cushion the contact point between the leg support 8 and the user's legs.

Also mounted to shaft 20 is a bracket 22 which has counterweight 24 attached to it in a conventional manner. Shaft 20 is fixed, preferably welded, to cam 40, such that when a user applies a force to the input assembly 30, the input assembly 30, the shaft 20 and the cam 40 all rotate together in the same direction.

Figure 2:
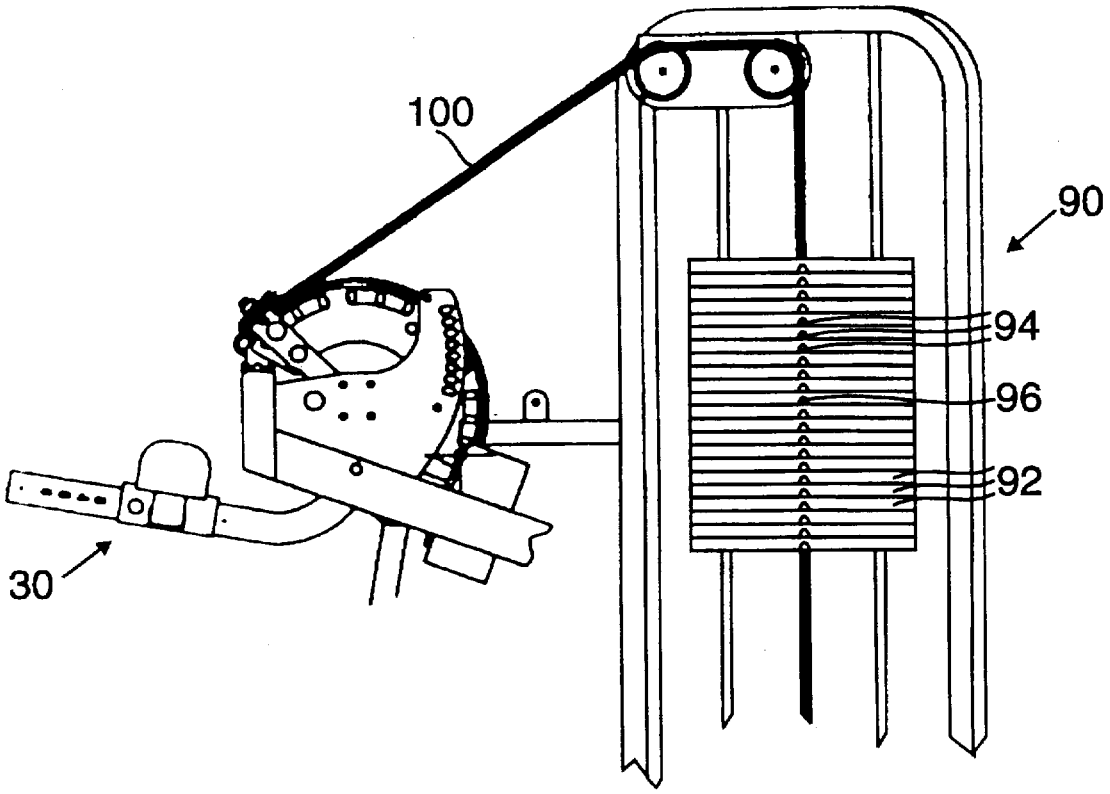
FIG. 2 is a partial side elevational view of the weight stack and tether assembly of the exercise machine of FIGS. 1A and 1B.

As best seen in FIG. 2, the exercise machine also includes a conventional weight stack 90 for providing resistance to the rotation of the input assembly 30. The weight stack 90 is selectively connected to one end of a tether 100 by inserting a pin 96 in one of a plurality of holes 94 in the weight plates 92, as is well known in the art. The tether 100 extends up from the weight stack 90 and an intermediate portion of tether 100 extends over pulleys 2.

Figure 3C:
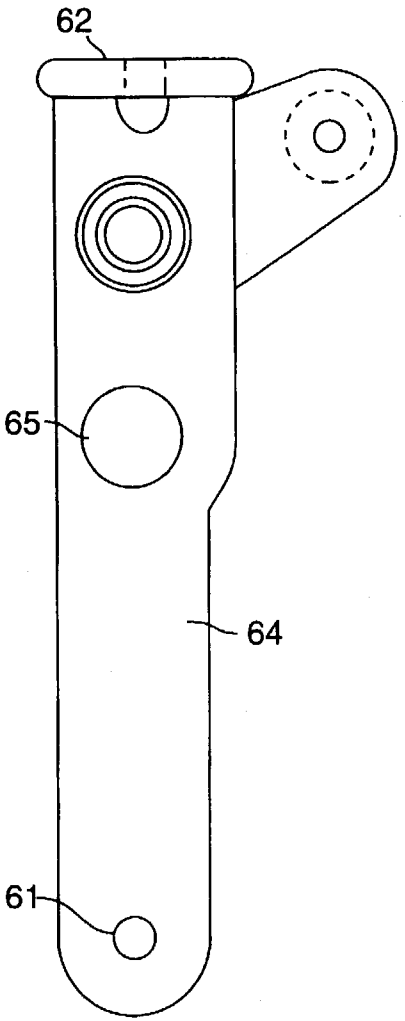
FIG. 3C is a side elevational view of the cam arm of FIG. 3A.
Figure 3A:
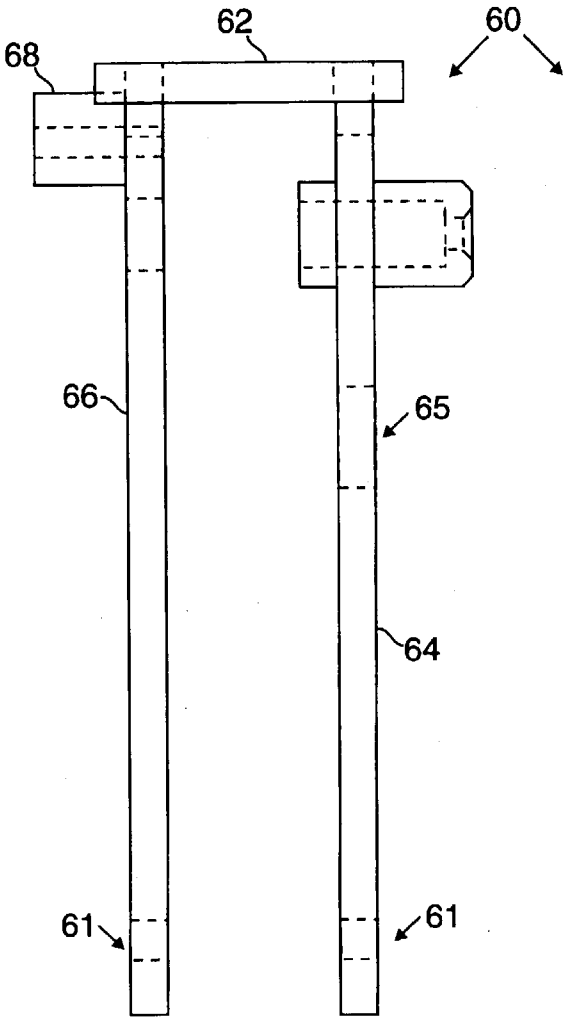
FIG. 3A is a front elevational view of the cam arm of the present invention.
Figure 3B:
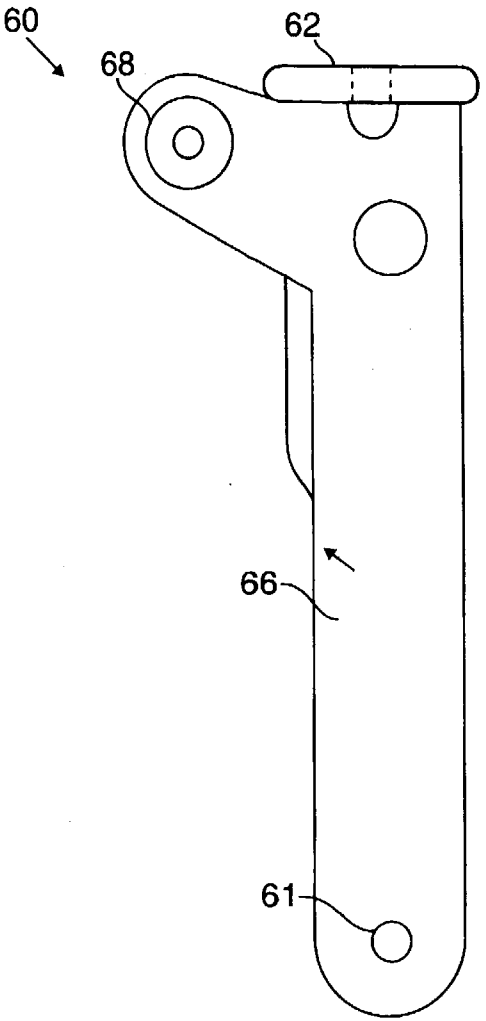
FIG. 3B is a side elevational view of the cam arm of FIG. 3A.

The second end of the tether 100 is connected to a tether support assembly 50 which is mounted to the cam 40 and provides for adjustment of the start position in accordance with the present invention. The tether support assembly 50 includes a cam arm 60 which is shown in detail in FIGS. 3A–3C. The cam arm 60 is generally U-shaped having a top 62, and two legs 64 and 66. The tether 100 is attached by means of a clamp assembly 58 to the top 62 of the cam arm 60. The cam arm 60 is rotatably mounted at holes 61 to cam 40 at hole 41 such that one leg 64, 66 of the cam arm is disposed on each lateral side of the cam 40. The cam arm 60 is mounted to the cam 40 by way of bearings, as is conventional in the art.

Figure 4A:
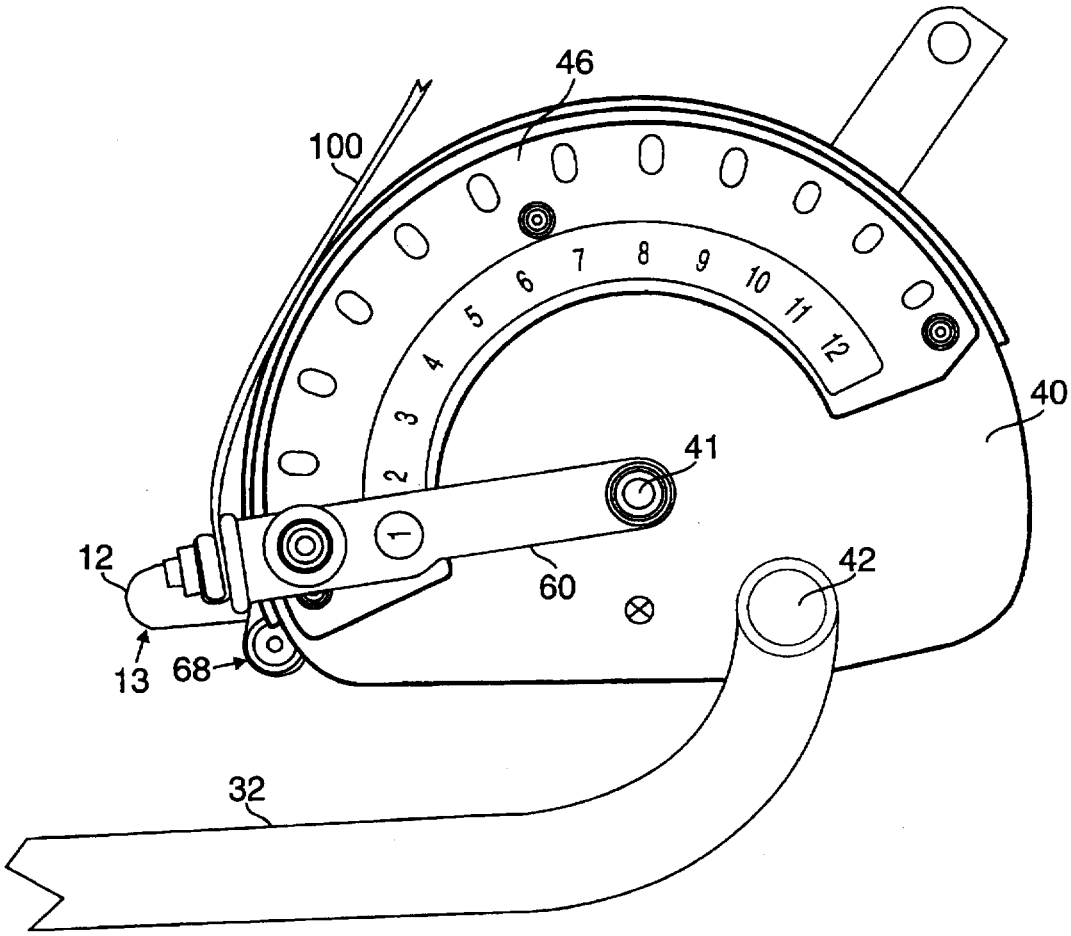
FIGS. 4A and 4B are side elevational views of the cam and cam arm of the present invention.
Figure 4B:
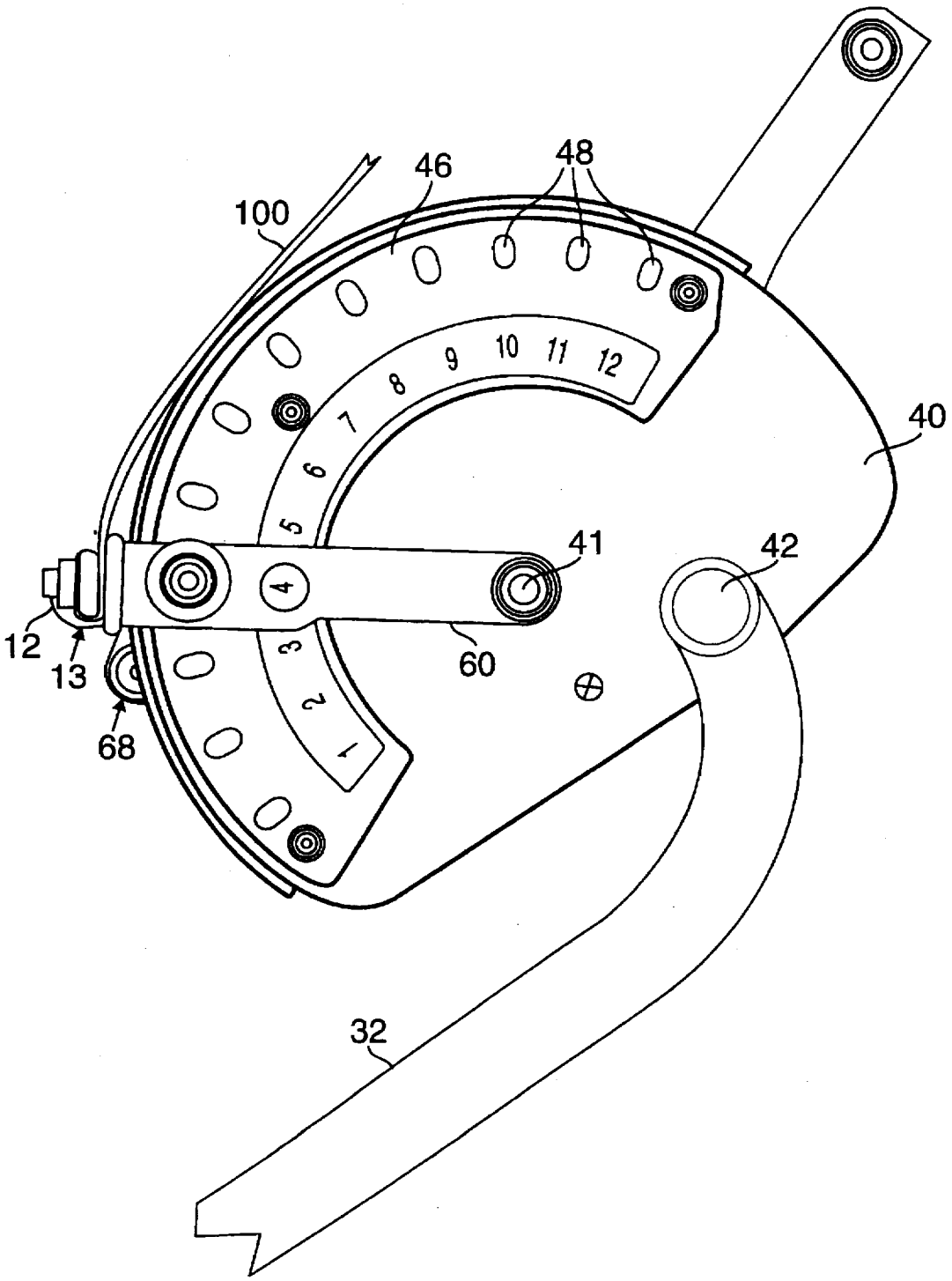

With reference to FIGS. 4A and 4B, the pivotal mounting point 41 of the cam arm 60 to the cam 40 is chosen so that the tether 100 is maintained substantially tangential to the outer perimeter of the cam 40 throughout the allowable start position adjustment range. If a variable radius cam is used, as is common in variable resistance exercise machines, the pivotal point 41 of the cam arm 60 will be different than the pivotal point 42 of the cam 40. For example, a portion of the perimeter of the cam 40 may form an arc having a center 41 different than the pivotal axis 42 of the cam 40. In such a case, a desirable location for the pivot axis 41 of the cam arm 60 would coincide with this arc center.

A cam plate 46 is mounted to the lateral side of cam 40. The cam plate 46 includes holes 48 which are used to indicate the start positions for the exercise being performed. The hole locations are spaced at equal intervals along the outer portion of the cam plate 46 and are each spaced the same distance from the cam arm 60 pivot axis 41. The holes 48 need not be spaced at equal intervals, but it is preferred.

It should be noted that the holes 48 could alternatively be in the cam 40 itself, rather than in a separate plate. In the preferred embodiment the holes 48 are in a separate plate 46 because the area around the holes 48 is subject to excessive wear due to the repeated insertion of the detent pin 70 (described below). Accordingly, the plate 46 may be chrome plated to reduce such wear without having to chrome plate the entire cam 40.

Figure 5:
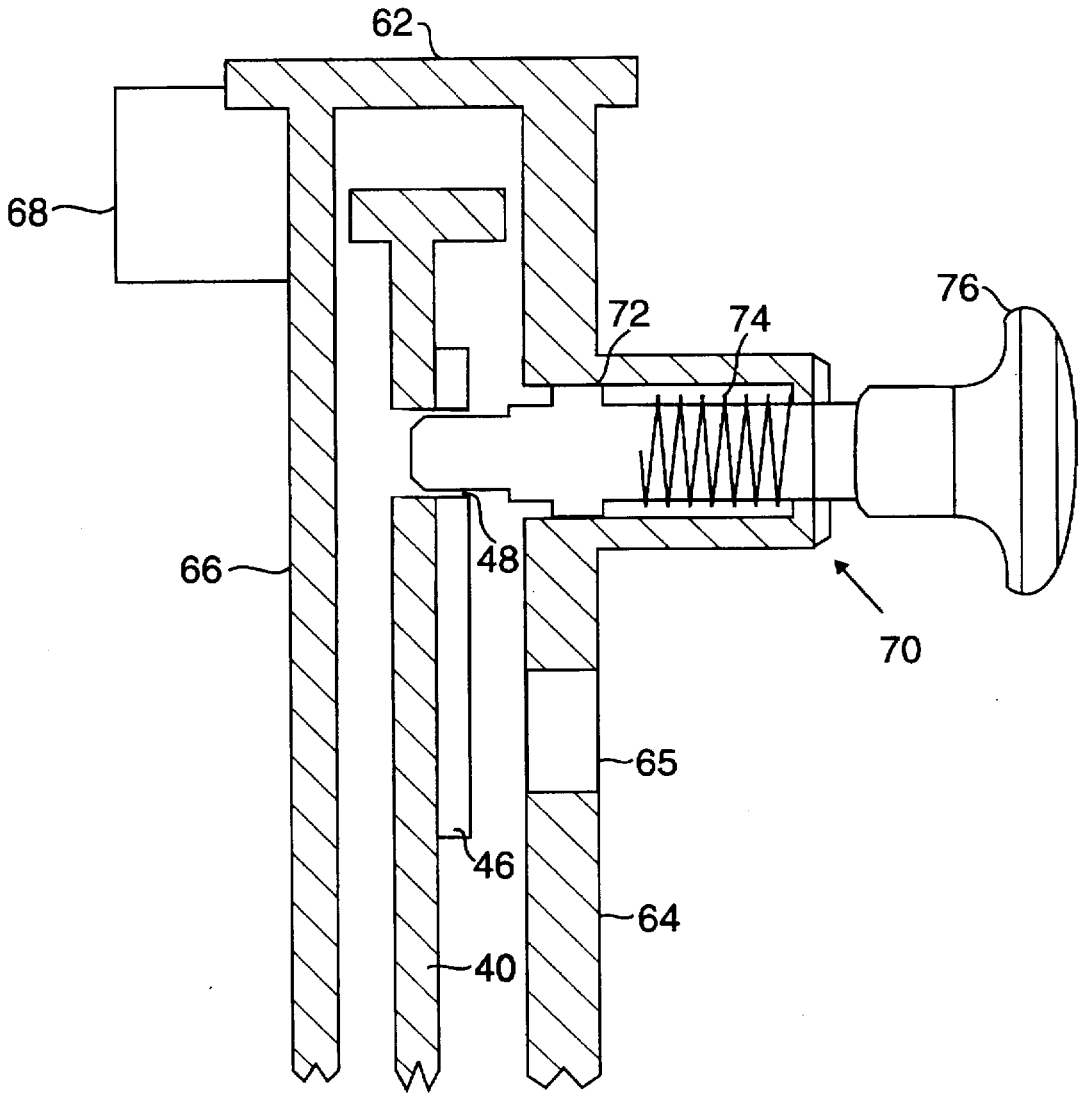
FIG. 5 is a cross-sectional view of the cam arm detent pin of the present invention.

A cam arm detent pin 70 is mounted to leg 64 of the cam arm 60 distal to the cam arm 60 pivot point 41 and is positioned to engage the holes 48 in the cam plate 46. As shown in FIG. 5, the cam arm detent pin 70 comprises a pin 72 which is biased towards the cam 40 by spring 74 such that at rest, the pin 72 will be engaged in one of the holes 48. When pin 72 is engaged through one of the holes 48 in cam plate 46, cam arm 60, cam 40, shaft 20, and input assembly 30 are mechanically connected. Thus, the tether 100 is mechanically connected to the input assembly 30 and the weight stack 90 moves as the user rotates the input assembly 30. To change the start position, the user disengages the pin 72 from the holes 48 by pulling on knob 76 and rotates the input assembly 30 (along with the shaft 20 and cam 40) to the desired start position, and re-engages the pin 72 into one of the holes 48.

The holes 48 can be labeled with letters or numbers to mark the different start positions and may be viewed through a window 65 in the leg 64 of the cam arm 60. These characters can appear on a decal 49 affixed to the cam 40 or they can be engraved in the cam 40 itself or in the cam plate 46. One of the holes 48 may be designated as the anatomical zero point. For example, the zero point for the leg curl machine may correspond to the full extension of a user's legs. Use of the zero point gives the therapist, trainer or user a frame of reference in setting the desired starting position.

It should be noted that although the currently preferred embodiment of the present invention employs detent pins, it is to be understood that other mechanical locking mechanisms may be utilized and still practice the invention. Examples of other locking mechanisms include conventional pins, latches, meshing gear teeth and clamps or other friction type devices.

A stop bar 12 prohibits the cam arm 60 from freely rotating beyond the position corresponding to the weight stack 90 being lowered. That is, it prevents the tether 100 from going slack when the cam arm 60 is disengaged from the cam 40 and acts as a mechanical stop to define the start position when the cam arm 60 is engaged to the cam 40. Referring to FIGS. 1A, 1B, 4A and 4B, the stop bar 12 is mounted to the frame 10, by bolts or some other means, adjacent to the lateral side of the cam 40. A cylindrical stop 68 is mounted to the cam arm 60 distal to the cam arm pivot axis, proximate to the end to which the tether 100 is connected. A cam follower 69 is pivotally mounted to the cylindrical stop 68 by a retaining screw. The stop bar 12 and the cylindrical stop 68 are located such that the cam follower 69 abuts the stop bar 12 when the weights 90 are lowered. The stop bar 12 thereby prevents the cam arm 60 from rotating past a point where the tether 100 would go slack. The cam follower 69 is free to roll along the lower edge 13 of the stop bar 12. This is to accommodate the fore and aft movement of the cam arm 60 resulting from adjustment of the start position which can be observed in comparing FIGS. 4A and 4B.

The stop position of the input assembly 30 is determined by a stop cam 80, best seen in FIGS. 1A and 1B. The stop cam 80 is mounted coaxially with the shaft 20 on rod 11 by bearings in a conventional manner. A handle 82 having a padded grip 83 is mounted to the outer perimeter of the stop cam 80 to facilitate easy rotation of the stop cam 80 about the rod 11. The stop cam 80 has holes 84, similar to the holes 48 in the cam plate 46, that are preferably spaced at equal intervals along the outer portion of the stop cam 80. However, unlike the holes 48 in the cam plate 46, the holes 84 in the stop cam 80 are each spaced the same distance from the pivot axis of the stop cam 80.

The stop cam 80 has a stop member 85 which extends laterally from the side of the stop cam 80 proximate the input arm 32. The stop member 85 is positioned to interfere with the movement of the input arm 32 and may include a rubber bumper 86 or the like to cushion the impact of the input arm 32 against the stop member 85. Thus, the stop position of the input assembly 30 is determined by the rotational orientation of the stop cam 80 about rod 11 with respect to the input arm 32. It should be noted that the stop member 85 could alternatively contact a protrusion on the cam 40 or the shaft 20 and still practice the present invention, provided that the limit of rotation of the arm 32 is determined by such action.

A second detent pin 14 is mounted to the frame 10 and positioned adjacent the stop cam 80 so as to be aligned with and engage the holes 84 in the stop cam 80. The orientation of the stop cam 80 can thereby be selectively fixed by a user by engaging the detent pin 14 in one of the holes 84. Accordingly, the user chooses the desired stop position by engaging detent pin 14 in one of the holes 84 to fix the orientation of the stop cam 80. Like holes 48 in the cam plate 46, the holes 84 in the stop cam 80 can be marked with alphanumeric characters to designate the stop position desired by the user. Likewise, these characters can appear on a decal 81 affixed to the stop cam 80 or they can be engraved in the stop cam 80 itself. Detent pin 14 functions similar to cam arm detent pin 70, and likewise may be replaced by a regular pin, a latch or some other mechanical locking means.

In operation, the start position for the training exercise or rehabilitation protocol, is set by a user by pulling knob 76 to overcome the biasing force of spring 74 and disengage pin 72 from one of the holes 48. This mechanically disconnects the cam arm 60 from the cam 40 which in turn results in the tether 100 (and weight stack 90) being mechanically separated from the cam 40 and input assembly 30. The user then rotates the input assembly 30 to the desired starting position. As set forth in the above description, the input assembly 30, the cam 40, and the shaft 20 move freely together thereby maintaining the synchronization of the cam mechanical advantage to that of the user. However, cam arm 60 does not move during the adjustment because the detent pin 70 is disengaged from the cam 40. Thus, the weights 90 will not be lifted. This permits the user to adjust the start position without having to lift the weight stack 90. When the user has chosen the desired start position, the user releases knob 76 and the pin 72 engages the selected hole 48.

To choose the stop position, the user pulls on knob 18 to disengage pin 16 from one of the holes 84. Once the user disengages detent pin 14, the user may rotate stop cam 80 to a desired stop position using handle 82. The user then releases the knob 18 to engage the pin 16 to one of the holes 84.

It should be apparent from the above description, that regardless of the input assembly 30 start position chosen, the cam arm 60 always starts at the same position, i.e, with the cam follower 69 resting against stop bar 12. When the arm 60 is mechanically attached to the input assembly 30 by engaging detent pin 70 in one of the cam holes 48, the device acts like a conventional selectorized variable resistance machine. Arm 60 is coupled with the cam 40 and moves with the cam 40 away from the stop bar 12, thereby providing resistance to the movement of the user.

Figure 6A:
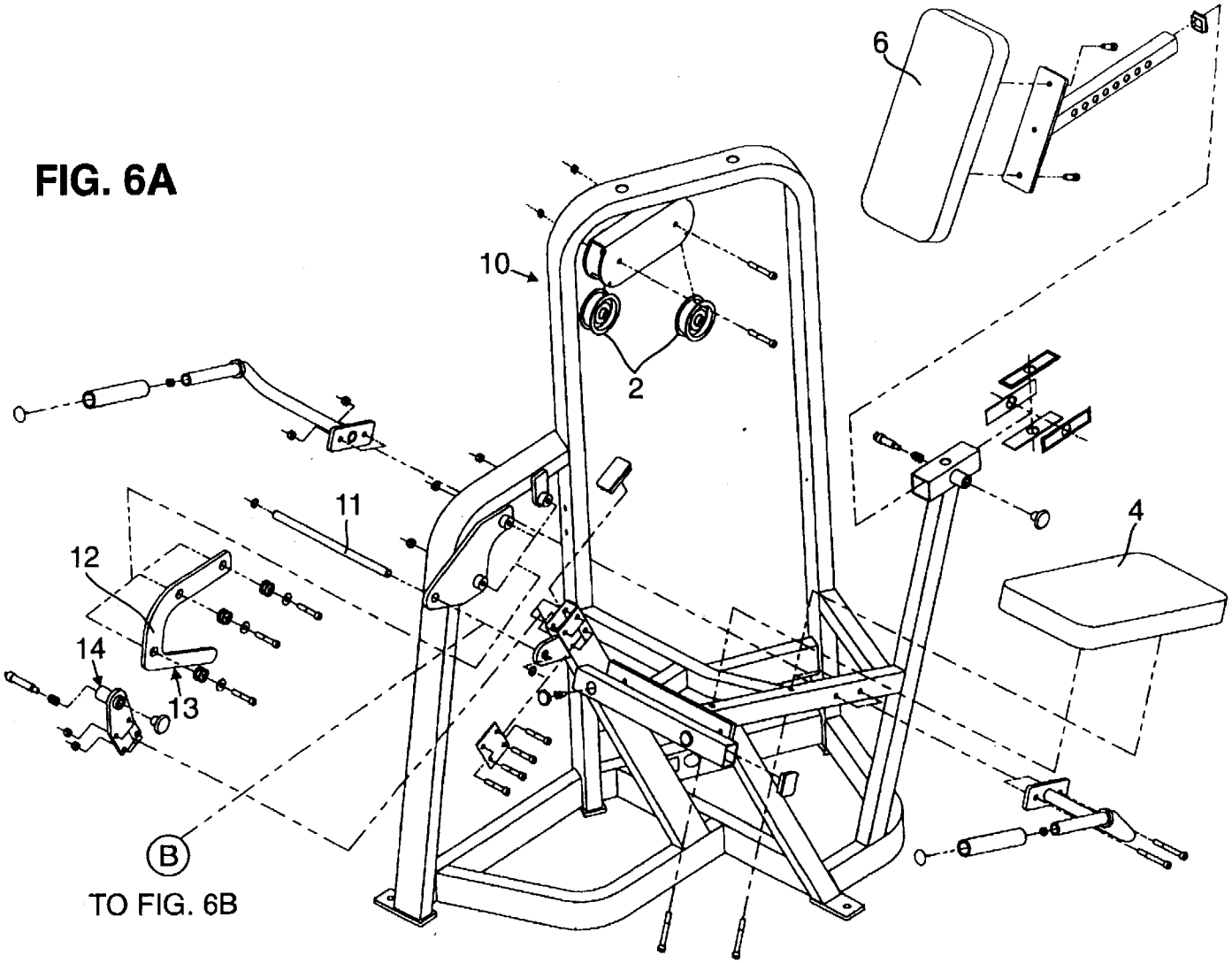
FIGS. 6A, 6B and 6C are an exploded view of a leg extension exercise machine having a range limiting device of the present invention.
Figures 6B, 6C:
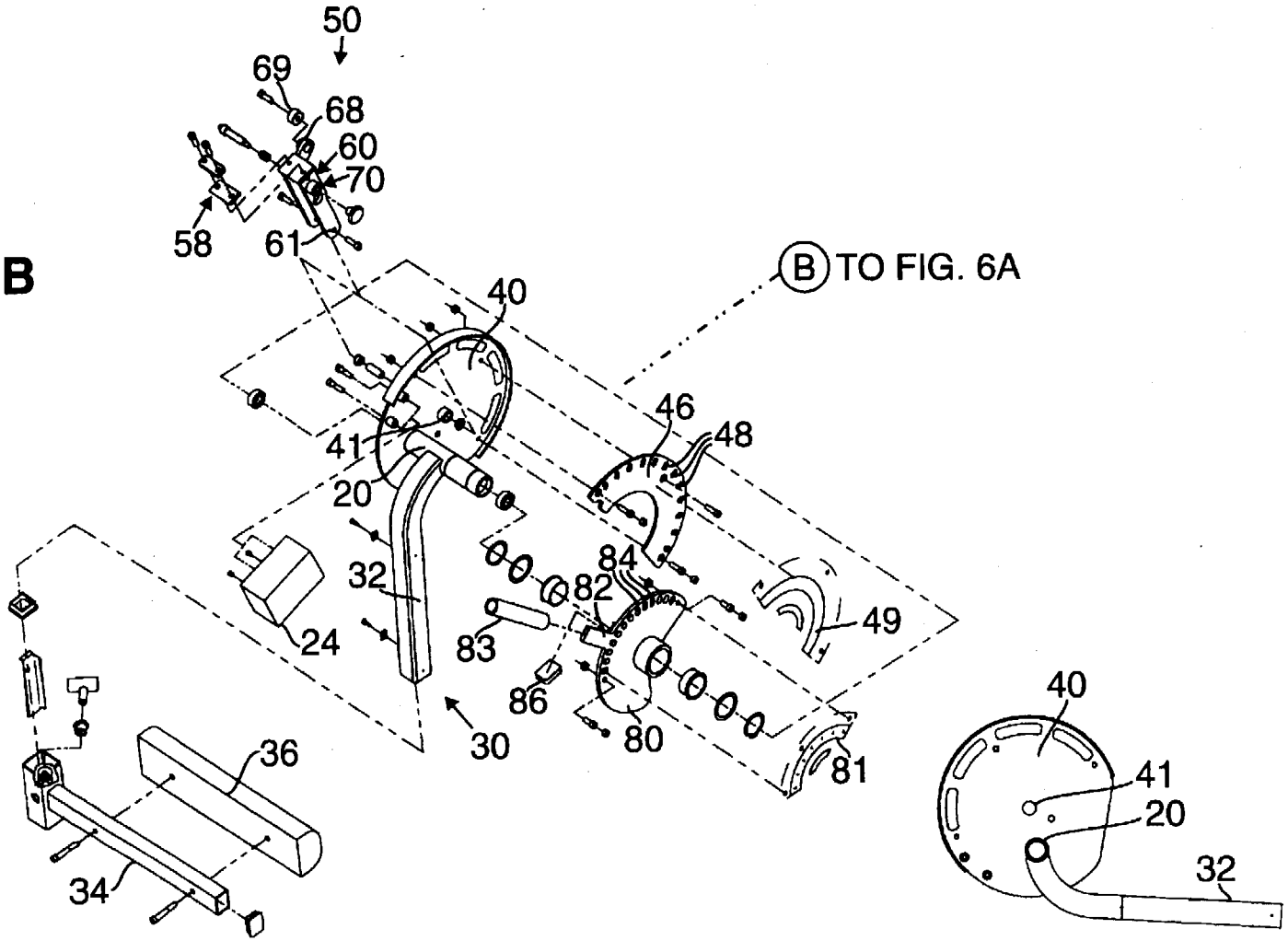

FIGS. 6A and 6B illustrate the present invention shown in an exploded view as part of a leg extension exercise machine. The left hand side of FIG. 6A is a continuation of the right hand side of FIG. 6B. This embodiment uses detent pins 14 and 70, as in the first embodiment, to adjust the start and stop positions for the range of motion. Like the leg curl exercise machine, the leg extension exercise machine includes an input assembly 30 and a cam 40 mounted to a shaft 20 which is pivotally mounted to the frame 10. Also like the leg curl exercise machine, the leg extension exercise machine has a cam arm 60 pivotally mounted to the cam 40 to maintain the tether (not shown) substantially tangential to the outer perimeter of the cam 40 throughout the allowable start position adjustment range and a stop bar 12 to limit the rotation of the cam arm 60. A stop cam 80 is pivotally mounted to the frame 10 coaxial with the shaft 20 as described in connection with the leg curl machine. However, because of the nature of the exercise to be performed, the above elements are oriented to resist rotation when the input assembly 30 is rotated upward rather than downward., i.e., when the user's legs are extended.

Figure 7A:
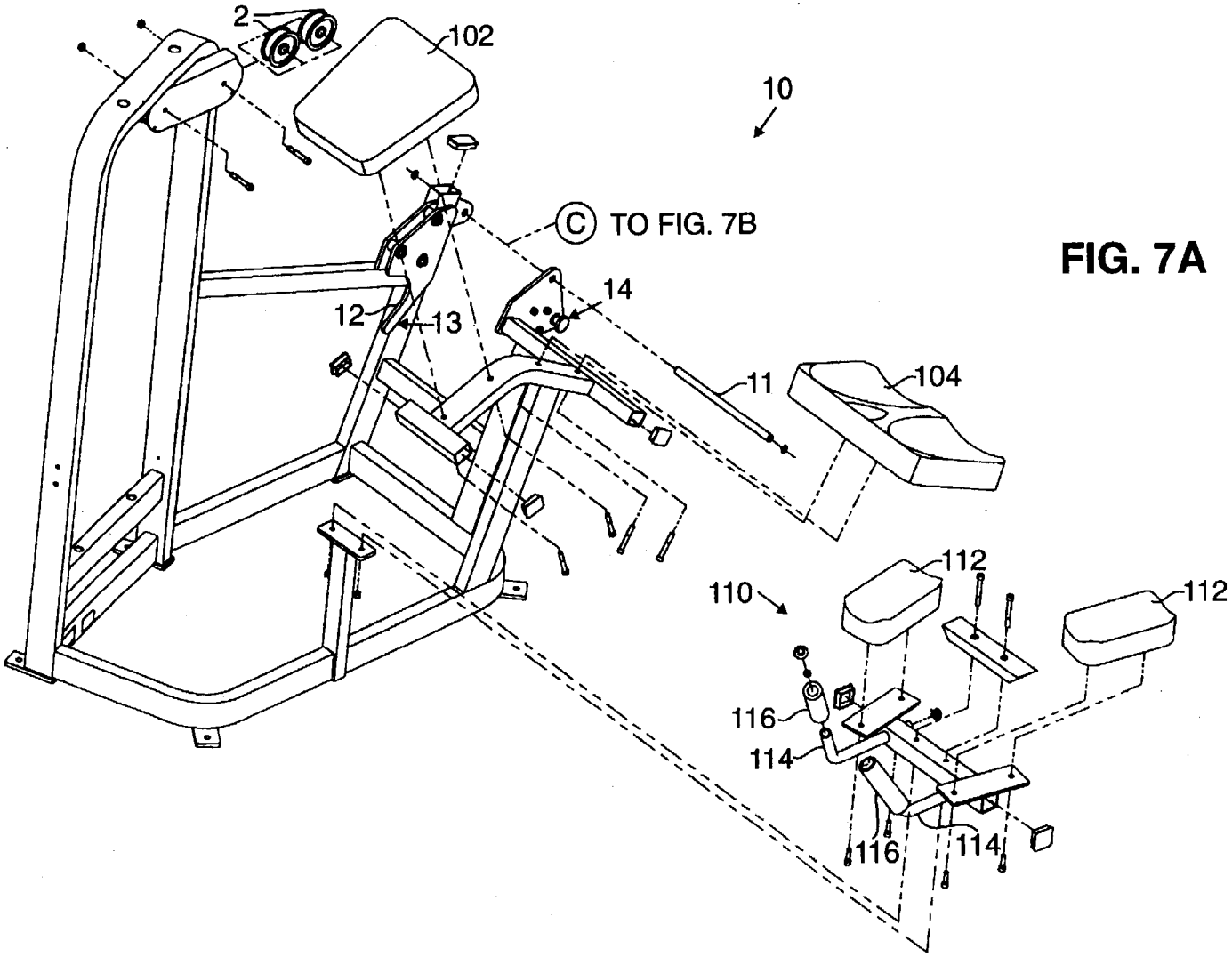
FIGS. 7A and 7B are an exploded view of a prone leg curl exercise machine having a range limiting device of the present invention.
Figure 7B:
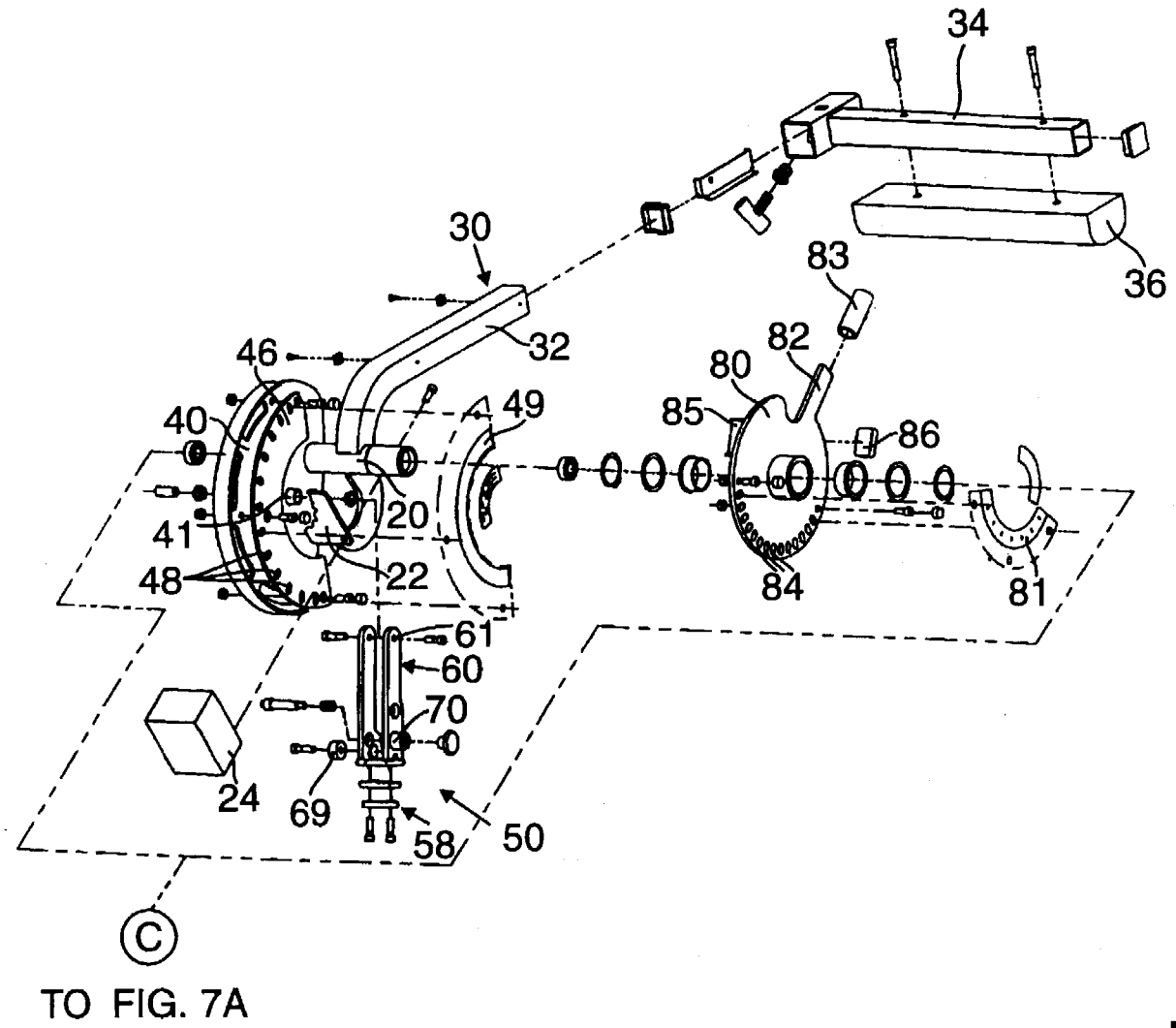

FIGS. 7A and 7B show the present invention as part of a prone leg curl exercise machine. This machine functions similar to the leg extension machine in that it resists upward movement of the input assembly 30, however, the user support is designed to support the user in a prone position, thereby allowing the user to perform a prone leg curl. Thus, the user support of the prone leg curl machine comprises a chest pad 102, a thigh pad 104 and an arm support assembly 110, all mounted to the frame to support a user in a prone position. The arm support assembly includes arm pads 112, handles 114 and padded grips 116. In all other respects, the prone leg curl exercise machine functions in a similar manner to the previously described exercise machines.

Figure 8A:
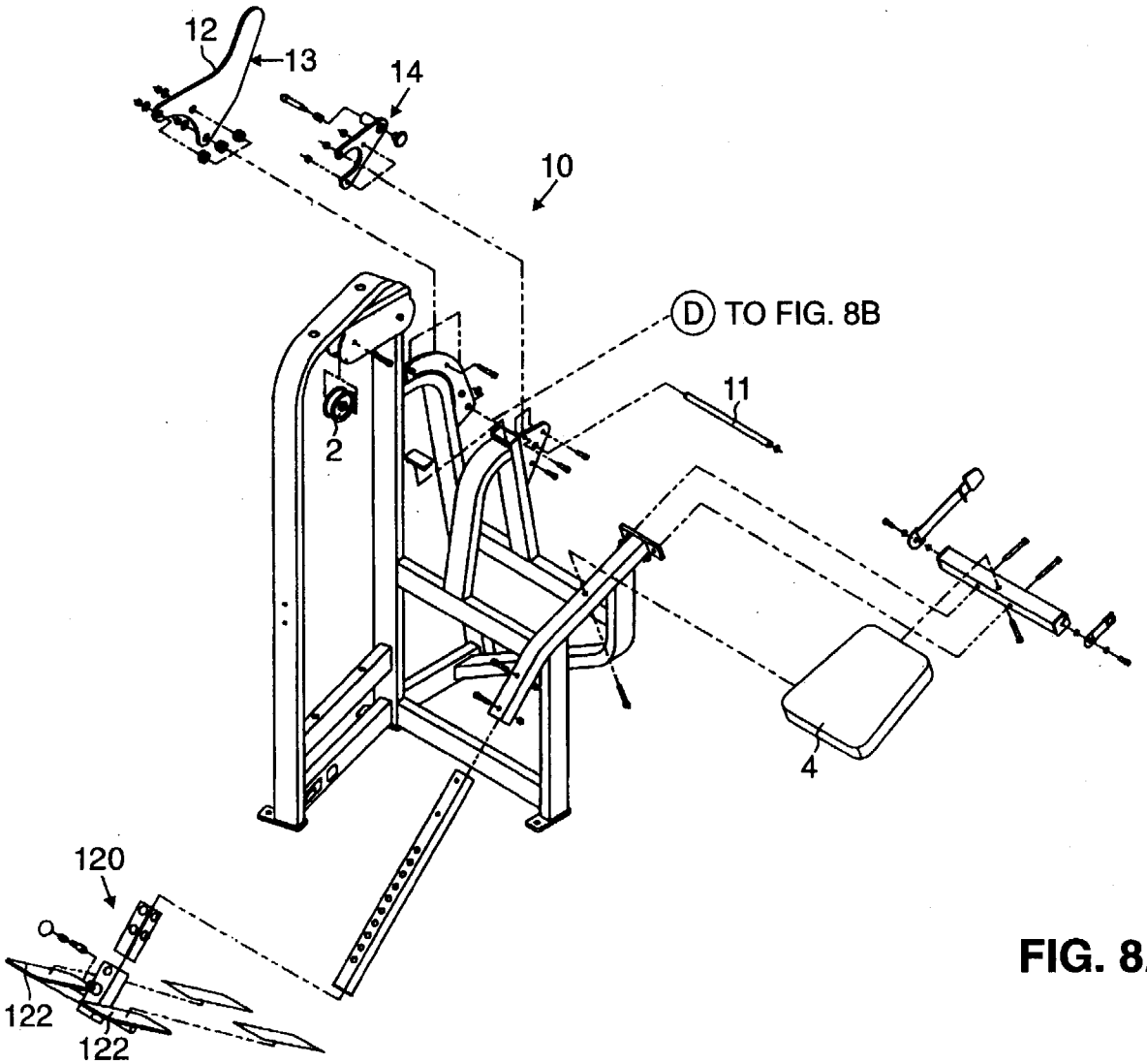
FIGS. 8A and 8B are an exploded view of a back extension exercise machine having a range limiting device of the present invention.
Figure 8B:
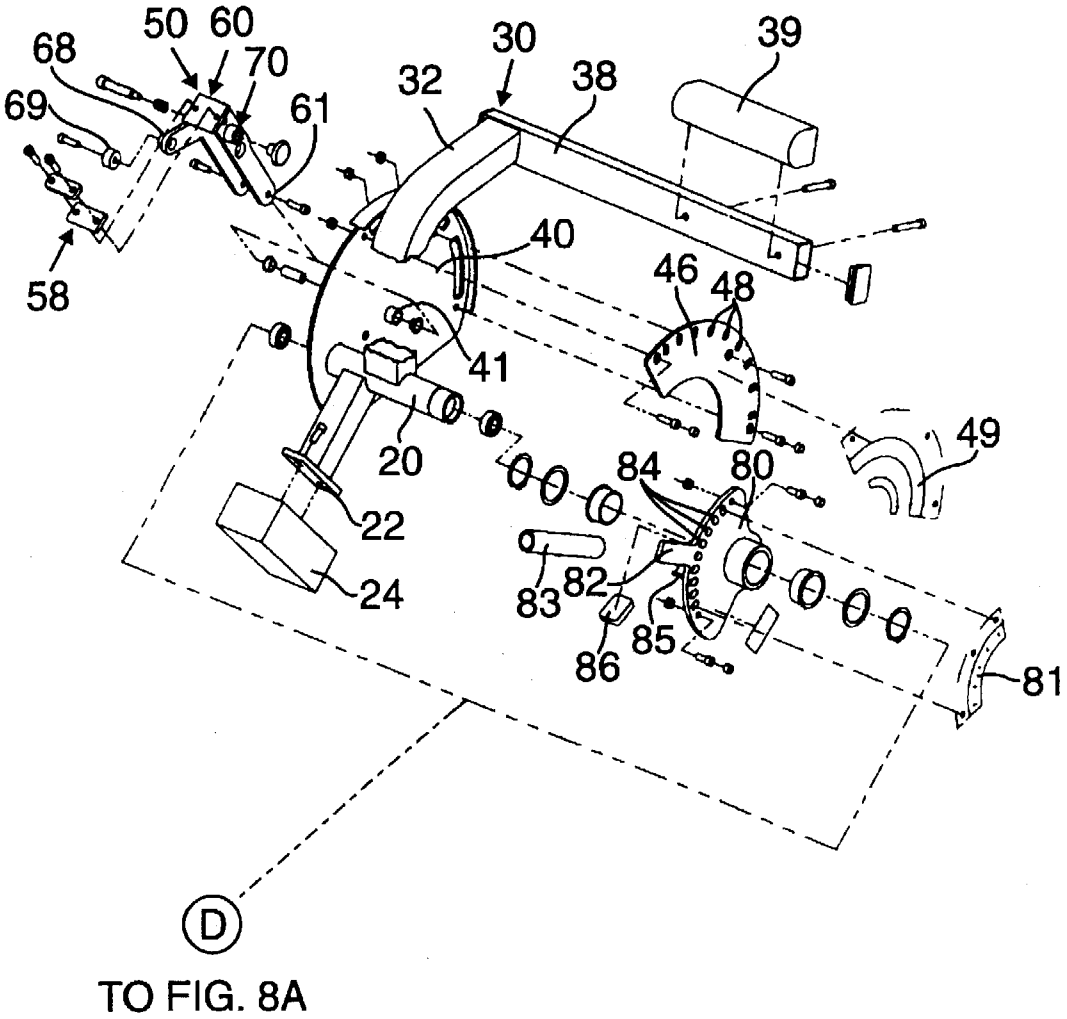

FIGS. 8A and 8B show the present invention as part of a back extension machine. Once again, this machine functions as the previous embodiments, however, the input assembly and user support are adapted to support a user in a sitting position and to resist the backward motion (i.e., extension) of the user's back. Accordingly, the input assembly 30 is positioned above the seat pad 4 and includes a back bar 38 adjustably mounted to the input arm 32. Like the leg bar, the back bar 38 has a back pad 39 mounted to it in order to cushion the user contact point. In addition, the user support has an adjustable foot support assembly 120, including foot plates 122, to provide a base for the user as the back extension is performed.

It is to be understood that the device of the present invention may be used on other weight machines which do not offer variable resistance to the user, such as machines where the cam is circular, and does not have a varying profile. Also, any weight loading means on the machine may be used to place a load on the input assembly. A weight stack on a selectorized weight machine has been disclosed in the above embodiments for exemplary purposes. Likewise, the present invention may be used on other exercise machines where a cam is rotated by an input assembly, for example, an arm curl machine, a rowing machine, etc.

The present invention has been described in terms of preferred embodiments thereof. Other embodiments, features and variations within the scope of the invention will, given the benefit of this disclosure, occur to those having ordinary skill in the art.

What is claimed is:

1. A weight machine having a range limiting device, said machine comprising:

a frame having a front and a rear;

a shaft pivotally mounted to the front of the frame, which shaft has a first axis of rotation;

a cam having an outer perimeter fixed to the shaft;

an input arm fixed to the shaft;

a cam arm pivotally mounted to the cam, which cam arm has a second axis of rotation, said second axis of rotation being different than said first axis of rotation;

means for selectively connecting the cam arm to the cam;

a tether fixed to the cam arm; and a weight loading means operably connected to the tether.

2. The apparatus of claim 1 further comprising a user support mounted to the rear of the frame.

3. The apparatus of claim 2 wherein the user support comprises:

seat mounted to the rear of the frame; and a backrest mounted to the frame behind and above the seat.

4. The apparatus of claim 3 wherein the user support further comprises a leg support mounted to the frame in front of and above the seat.

5. The apparatus of claim 2 further comprising a stop bar mounted to the frame proximate the cam arm, wherein the cam arm includes a stop positioned to abut said stop bar.

6. The apparatus of claim 1 further comprising a leg bar slidably mounted to the input arm.

7. The apparatus of claim 1 wherein the connecting means comprises a detent pin mounted to the cam arm, and wherein the cam includes apertures for engaging said detent pin.

8. The apparatus of claim 1 further comprising a stop cam pivotally mounted to the frame coaxial with the shaft, said stop cam having a stop member for interfering with the rotation of said input arm.

9. The apparatus of claim 8 further comprising a detent pin mounted to the frame proximate the stop cam, and wherein the stop cam includes apertures for engaging said detent pin.

10. The apparatus of claim 1 wherein the weight loading means comprises a weight stack.

11. In a weight machine having a frame, a shaft pivotally mounted to the frame for rotation about a first axis, a cam fixed to the shaft, an input arm fixed to the shaft, a weight loading means and a tether operably connected to the weight loading means, a range limiting device comprising:

a cam arm;

means for attaching the tether assembly to the cam arm;

first connecting means for pivotally mounting the cam arm to the cam for rotation about a second axis, different than said first axis such that the tether is maintained substantially tangential to an outer profile of the cam; and second connecting means for selectively connecting the cam arm to the cam.

* * * * *